US005373589A

United States Patent [19]

Rego et al.

[11] Patent Number: 5,373,589

[45] Date of Patent: Dec. 20, 1994

[54] COMMODE BOWL SPLASH GUARD

[76] Inventors: Robert J. Rego; Mary E. Levesque, both of 29 Sawdy Pond Rd., Tiverton, R.I. 02878

[21] Appl. No.: 226,931

[22] Filed: Apr. 13, 1994

[51] Int. Cl.[5] ..... E03D 9/00

[52] U.S. Cl. ..... 4/300.3; 4/DIG. 5

[58] Field of Search ..... 4/300.3, DIG. 5, 661

[56] References Cited

U.S. PATENT DOCUMENTS 3,193,845 7/1965 Funk ..... 4/300.3
3,914,803 10/1975 Gregovski .
3,931,649 1/1976 Jankowski .
4,010,497 3/1977 Menter et al. .
4,133,062 1/1979 Fulbright ..... 4/DIG. 5
4,348,776 9/1982 Sarjeant .
4,912,784 4/1990 Jacobson et al. .
5,117,512 6/1992 Bressler ..... 4/300.3

FOREIGN PATENT DOCUMENTS 4023242 1/1992 Germany ..... 4/300.3

*Primary Examiner*—Charles E. Phillips

[57] ABSTRACT

A flexible member formed of opposed and facing accordion pleated triangular walls is arranged to orient the triangular walls on diametrically opposed sides of a commode bowl mounted to a commode bowl top wall, with the V-shaped walls further mounted to a commode lid bottom wall, such that lifting of the commode lid effects opening of the V-shaped walls to provide for a shield structure relative to the commode bowl.

3 Claims, 2 Drawing Sheets

COMMODE BOWL SPLASH GUARD

BACKGROUND OF THE INVENTION

1. Field of the Invention

The field of invention relates to commode bowl splash guard structure, and more particularly pertains to a new commode bowl splash guard wherein the same is arranged to afford protection relative to splashing adjacent a commode bowl structure.

2. Description of the Prior Art

Commode bowl structure such as indicated in U.S. Pat. Nos. 3,914,803; 4,348,776; and 4,912,784 are available in the prior art.

The prior art has heretofore failed to afford the use of accordion pleated structure permitting ease of interfolding of the structure during periods of non-use and in this respect, the present invention substantially fulfills this need.

SUMMARY OF THE INVENTION

In view of the disadvantages inherent in the known types of commode bowl splash guard structure now present in the prior art, the present invention provides a commode bowl splash guard wherein the same is arranged to provide for a barrier relative to diametrically opposed sides of the commode bowl.

To attain this, the present invention provides a flexible member formed of opposed and facing accordion pleated triangular wails arranged to orient the triangular walls on diametrically opposed sides of a commode bowl mounted to a commode bowl top wall, with the V-shaped walls further mounted to a commode lid bottom wall, such that lifting of the commode lid effects opening of the V-shaped walls to provide for a shield structure relative to the commode bowl.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is an object of the present invention to provide a new commode bowl splash guard which may be easily and efficiently manufactured and marketed.

It is a further object of the present invention to provide a new commode bowl splash guard which is of a durable and reliable construction.

An even further object of the present invention is to provide a new commode bowl splash guard which is susceptible of a low cost of manufacture with regard to both materials and labor, and which accordingly is then susceptible of low prices of sale to the consuming public, thereby making such commode bowl splash guards economically available to the buying public.

Still yet another object of the present invention is to provide a new commode bowl splash guard which provides in the apparatuses and methods of the prior art some of the advantages thereof, while simultaneously overcoming some of the disadvantages normally associated therewith.

Even still yet another object of the present invention is to provide a new commode bowl splash guard which provides a flexible member formed of opposed and facing accordion pleated triangular walls arranged to orient the triangular walls on diametrically opposed sides of a commode bowl mounted to a commode bowl top wall, with the V-shaped walls further mounted to a commode lid bottom wall, such that lifting of the commode lid effects opening of the V-shaped walls to provide for a shield structure relative to the commode bowl.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 2:
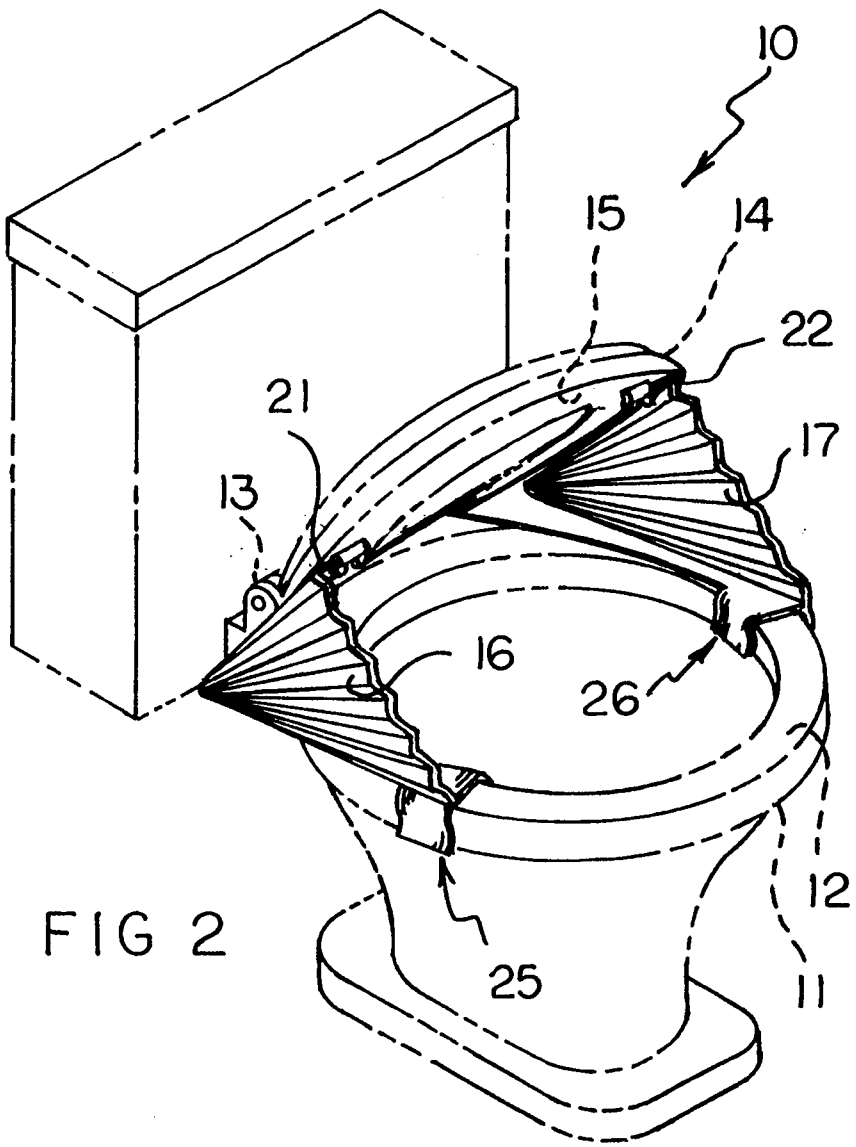
FIG. 2 is an isometric illustration of the invention arranged for partial opening relative to the commode bowl structure.

With reference now to the drawings, and in particular to FIGS. 1-4 thereof, a new commode bowl splash guard embodying the principles and concepts of the present invention and generally designated by the reference numeral 10 will be described.

Figure 3:
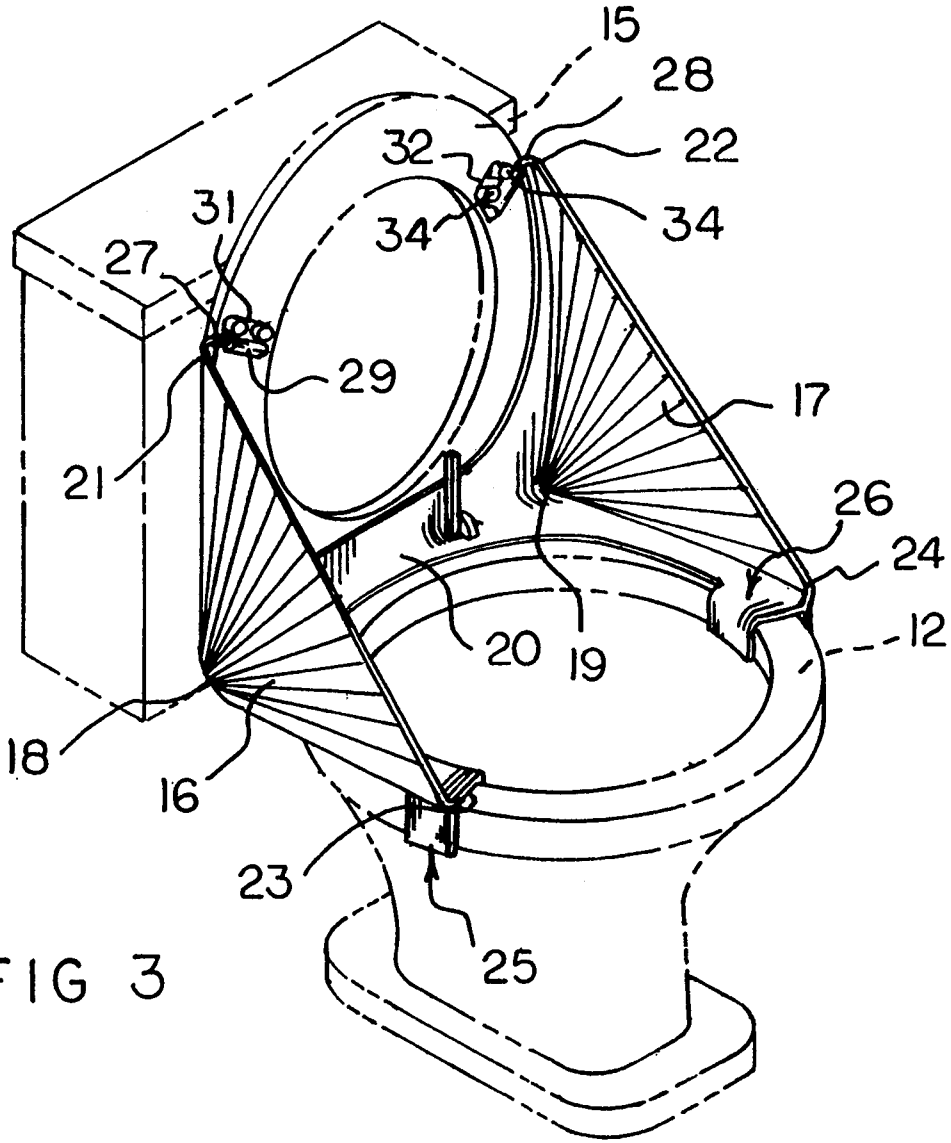
FIG. 3 is an isometric illustration of the invention in a fully opened configuration relative to the commode bowl structure.

More specifically, the commode bowl splash guard 10 of the instant invention is arranged for securement to a commode bowl 11 having an annular top wall rim 12, with a hinge 13 mounted to the annular top wall 12 adjacent the commode bowl tank, such that a scat 14 having a scat bottom wall 15 is hingedly mounted about the hinge 13 relative to the top wall rim 12. The invention 10 comprises first and second accordion pleated webs 16 and 17 provided in a facing coextensive relationship relative to one another and mounted to diametrically opposed sides of the annular top wall 12, with the first web 16 including a first web apex 18 adjacent the hinge 13, and the second web 17 having a second web apex 19 adjacent the hinge 13, as shown in FIG. 3. A connecting web 20 extends between the first and second apexes 18 and 19 to form a substantially water tight enclosure.

Figure 1:
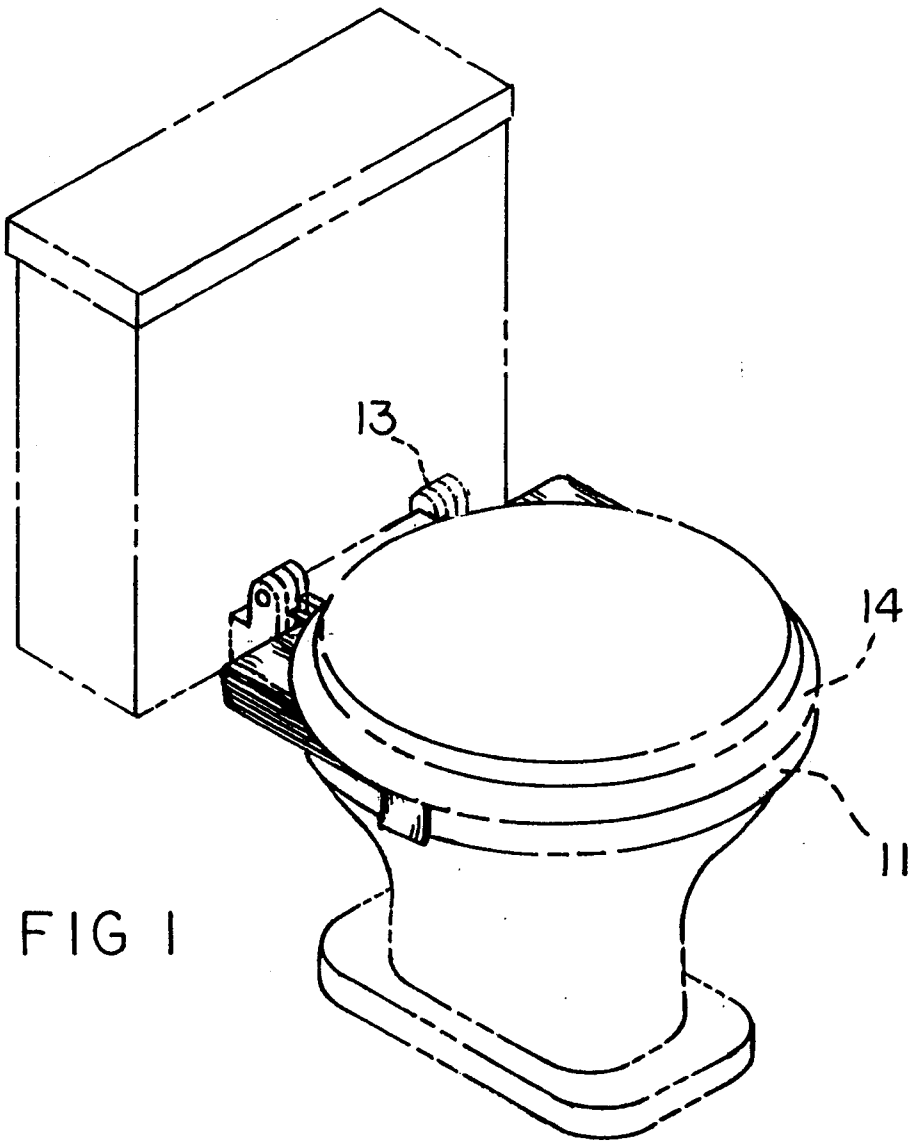
FIG. 1 is an isometric illustration of the invention in a folded configuration relative to an associated commode structure.
Figure 4:
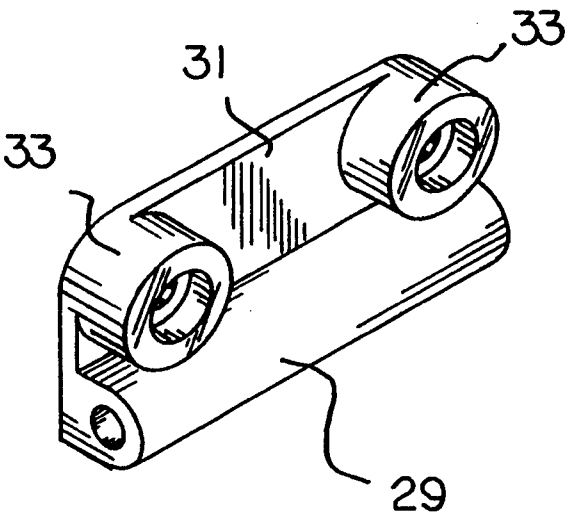
FIG. 4 is an isometric illustration of an individual support tube structure arranged for mounting onto the bottom wall of the commode seat.

The first web 16 includes a first web first end 21 having a first mounting leg 27, and the second web 17 includes a second web first end 22 having a second mounting leg 28. Each mounting leg 27 and 28 extends to the respective apex 18 and 19 of the respective web 16 and 17, whereat the mounting leg bends to extend into a parallel relationship with the commode bowl rim 12 and provide a resilient spring force tending to extend the webs into an open configuration. To securely couple the device 10 to the commode bowl lid 15, the first mounting leg 27 is pivotally received within a first leg support tube 29, while the second mounting leg 28 is pivotally received within a second leg support tube 30 (see FIG. 3). The first and second leg tubes 29 and 30 are constructed, as indicated in FIGS. 3 and 4, to each include respective first and second extension flanges 31 and 32 that in turn are secured to the seat bottom wall 15 by mechanical fasteners, adhesives, or the like as desired and convenient. To secure the web 16 and 17 to the commode bowl rim 12, the first web 16 further includes a first web second end 23 mounting a first web C-shaped resilient clamp 25 arranged to engage the commode bowl 11 by extending over the top wall 12, and the second web 17 has a second web second end 24, with a second web C-shaped resilient clamp 26 mounted onto the commode bowl 11 and extending over the top wall 12. In addition, respective first and second bumper pairs 33 and 34 are arranged for extension from the first and second flanges 31 and 32 respectively to provide for a cushioned engaging surface to engage the respective C-shaped clamps 25 and 26 respectively when in a stored configuration, as indicated in FIG. 1.

As to the manner of usage and operation of the instant invention, the same should be apparent from the above disclosure, and accordingly no further discussion relative to the manner of operation of the instant invention shall be provided.

Thus, while the present invention has been shown in the drawings and fully described above with particularity and detail in connection with what is presently deemed to be the most practical and preferred embodiment(s) of the invention, it will be apparent to those of ordinary skill in the art that many modifications thereof may be made without departing from the principles and concepts set forth herein, including, but not limited to, variations in size, materials, shape, form, function and manner of operation, assembly and use.

Hence, the proper scope of the present invention should be determined only by the broadest interpretation of the appended claims so as encompass all such modifications as well as all relationships equivalent to those illustrated in the drawings and described in the specification.

Finally, it will be appreciated that the purpose of the Abstract provided at the beginning of this specification is to enable the U.S. Patent and Trademark Office and the public generally, and especially the scientists, engineers and practitioners in the art who are not familiar with patent or legal terms of phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

What is claimed as being new and desired to be protected by Letters Patent of the United States is as follows:

1. A commode bowl splash guard arranged for use with a commode bowl having a commode bowl annular top wall rim and a commode bowl seat, with a hinge pivotally mounting the seat to the top wall, the seat having a bottom wall, said splash guard comprising:

a first V-shaped accordion pleated web, the first web having a first web apex, a first web first end, and a first web second end;

a second V-shaped accordion pleated web positioned in a facing coextensive relationship relative to the first V-shaped accordion pleated web, the second web having a second web apex, a second web first end, and a second web second end;

a connecting web extending between the first web apex and the second web apex;

a first mounting leg mounted to the first web first end;

a second mounting leg mounted to the second web first end;

a first web C-shaped resilient clamp mounted to the first web second end for attachment to said bowl rim with the first web C-shaped resilient clamp engaging the commode bowl top wall rim;

a second web C-shaped resilient clamp mounted to the second web second end for attachment to said bowl rim with the second web C-shaped resilient clamp engaging the commode bowl top wall rim;

a first leg support tube mountable to the seat bottom wall for pivotally receiving said first mounting leg therein so as to attach said first mounting leg to said bottom wall; and, a second leg support tube mountable to the seat bottom wall for pivotally receiving said second mounting leg therein so as to attach said first mounting leg to said bottom wall.

2. A guard as set forth in claim 1, wherein each of the mounting legs extends to the apex of web, whereat the mounting leg bends to extend into a parallel relationship with the commode bowl top wall rim to provide a resilient spring force tending to extend the webs into an open configuration.

3. A guard as set forth in claim 2, and further comprising at least one bumper mounted to each of said leg support tubes arranged to engage one of the C-shaped resilient clamps.

* * * * *